US012317934B2

(12) United States Patent
Moloney et al.

(10) Patent No.: US 12,317,934 B2
(45) Date of Patent: Jun. 3, 2025

(54) ELECTRONIC AEROSOL PROVISION SYSTEM AND METHOD

(71) Applicant: NICOVENTURES TRADING LIMITED, London (GB)

(72) Inventors: Patrick Moloney, London (GB); Justin Han Yang Chan, London (GB)

(73) Assignee: NICOVENTURES TRADING LIMITED, London (GB)

( * ) Notice: Subject to any disclaimer, the term of this patent is extended or adjusted under 35 U.S.C. 154(b) by 389 days.

(21) Appl. No.: 17/754,937

(22) PCT Filed: Sep. 17, 2020

(86) PCT No.: PCT/GB2020/052252
§ 371 (c)(1),
(2) Date: Apr. 15, 2022

(87) PCT Pub. No.: WO2021/074583
PCT Pub. Date: Apr. 22, 2021

(65) Prior Publication Data

US 2022/0361585 A1 Nov. 17, 2022

(30) Foreign Application Priority Data

Oct. 16, 2019 (GB) ..... 1914947

(51) Int. Cl.
*A24F 40/53* (2020.01)
*A24F 40/51* (2020.01)
(Continued)

(52) U.S. Cl.
CPC ..... *A24F 40/53* (2020.01); *A24F 40/51* (2020.01); *A24F 40/10* (2020.01); *A24F 40/65* (2020.01)

(58) Field of Classification Search
None
See application file for complete search history.

(56) References Cited

U.S. PATENT DOCUMENTS 10,398,175 B2 * 9/2019 Thorens ..... A24F 40/53
2013/0340750 A1 12/2013 Thorens et al.
(Continued)

FOREIGN PATENT DOCUMENTS

EP 3272382 A1 1/2018
JP 2013545474 A 12/2013
(Continued)

OTHER PUBLICATIONS

International Search Report and Written Opinion for Application No. PCT/GB2020/052252, mailed on Dec. 8, 2020, 15 pages.

*Primary Examiner* — Ross N Gushi
(74) *Attorney, Agent, or Firm* — BURR & FORMAN LLP

(57) ABSTRACT

A method of user characterization for an aerosol provision system is disclosed herein. The system is configured to generate aerosol from an aerosol generating material for user inhalation. The method involves detecting an airflow associated with the start of a user inhalation upon the aerosol provision system, calculating a gradient for the air flow during a first period following the start of inhalation, predicting at least one of an inhalation intensity and duration, based upon the calculated gradient, and adjusting one or more operational parameters of the aerosol provision system in response to the at least one predicted inhalation intensity and duration.

20 Claims, 5 Drawing Sheets

(51) Int. Cl.
*A24F 40/10* (2020.01)
*A24F 40/65* (2020.01)

(56) References Cited

U.S. PATENT DOCUMENTS

| | | | |
|---|---|---|---|
| 2014/0321837 | A1 | 10/2014 | Flick |
| 2015/0047662 | A1 | 2/2015 | Hopps et al. |
| 2017/0318861 | A1 | 11/2017 | Thorens et al. |
| 2017/0347707 | A1 | 12/2017 | Xiang |
| 2019/0246703 | A1 | 8/2019 | Nakano et al. |

FOREIGN PATENT DOCUMENTS

| | | | |
|---|---|---|---|
| JP | 2017538408 | A | 12/2017 |
| JP | 2018007691 | A | 1/2018 |
| WO | WO-2013060784 | A2 | 5/2013 |
| WO | WO-2018099663 | A1 | 6/2018 |

* cited by examiner

ELECTRONIC AEROSOL PROVISION SYSTEM AND METHOD

PRIORITY CLAIM

The present application is a National Phase entry of PCT Application No. PCT/GB2020/052252, filed Sep. 17, 2020, which claims priority from GB Patent Application No. 1914947.5, filed Oct. 16, 2019, which is hereby fully incorporated herein by reference.

FIELD

The present disclosure relates to an electronic aerosol provision system and method.

BACKGROUND

Electronic aerosol provision systems such as electronic cigarettes (e-cigarettes) generally contain a reservoir of a source liquid containing a formulation, typically including nicotine, from which an aerosol is generated, e.g., through heat vaporization. An aerosol source for an aerosol provision system may thus comprise a heater having a heating element arranged to receive source liquid from the reservoir, for example through wicking or capillary action. Other source materials may be similarly heated to create an aerosol, such as botanical matter, or a gel comprising an active ingredient or flavoring. Hence, more generally, the e-cigarette may be thought of as comprising or receiving a payload for heat vaporization.

While a user inhales on the device, electrical power is supplied to the heating element to vaporize the aerosol source (a portion of the payload) in the vicinity of the heating element, to generate an aerosol for inhalation by the user. Such devices are usually provided with one or more air inlet holes located away from a mouthpiece end of the system. When a user sucks on a mouthpiece connected to the mouthpiece end of the system, air is drawn in through the inlet holes and past the aerosol source. There is a flow path connecting between the aerosol source and an opening in the mouthpiece so that air drawn past the aerosol source continues along the flow path to the mouthpiece opening, carrying some of the aerosol from the aerosol source with it. The aerosol-carrying air exits the aerosol provision system through the mouthpiece opening for inhalation by the user.

Usually an electric current is supplied to the heater when a user is drawing or puffing on the device. Typically, the electric current is supplied to the heater, e.g., resistance heating element, in response to either the activation of an airflow sensor along the flow path as the user inhales/draw/puffs or in response to the activation of a button by the user. The heat generated by the heating element is used to vaporize a formulation. The released vapor mixes with air drawn through the device by the puffing consumer and forms an aerosol. Alternatively or in addition, the heating element is used to heat but typically not burn a botanical such as tobacco, to release active ingredients thereof as a vapor or aerosol.

The amount of vaporized or aerosolized payload inhaled by the user will depend at least in part on how long and how deeply the user inhales and, over a period of time, how frequently the user inhales as well. In turn, these user behaviors may be influenced by their mood.

It is desirable to respond to these influences, whether in the immediate, near or longer term.

The "background" description provided herein is for the purpose of generally presenting the context of the disclosure. Work of the presently named inventors, to the extent it is described in this background section, as well as aspects of the description which are not available to the public at the time of filing, are neither expressly or impliedly admitted as prior art against the present disclosure.

SUMMARY

In a first aspect, a method of user characterization for an aerosol provision system is provided wherein the system configured to generate aerosol from an aerosol generating material for user inhalation. The method comprises detecting an airflow associated with the start of a user inhalation upon the aerosol provision system; calculating a gradient for the air flow during a first period following the start of inhalation; predicting at least one of an inhalation intensity and duration, based upon the calculated gradient; and adjusting one or more operational parameters of the aerosol provision system in response to the at least one predicted inhalation intensity and duration.

In another aspect, a user characterization system is provided comprising an electronic aerosol provision system configured to generate aerosol from an aerosol generating material for user inhalation and in turn comprising an airflow detector. The user characterization characterisation system comprises a processor operable to detect an airflow associated with the start of the user inhalation upon the aerosol provision system; a gradient captivating processor operable to calculate a gradient for the air flow during a first period following the start of inhalation; a prediction processor operable to predict at least one of an inhalation intensity and duration, based upon the calculated gradient; and a control unit operable to cause the adjustment of one or more operational parameters of the aerosol provision system in response to the at least one predicted inhalation intensity and duration.

It is to be understood that both the foregoing general summary of the disclosure and the following detailed description are exemplary, but are not restrictive, of the disclosure.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE EMBODIMENTS

Figure 1:
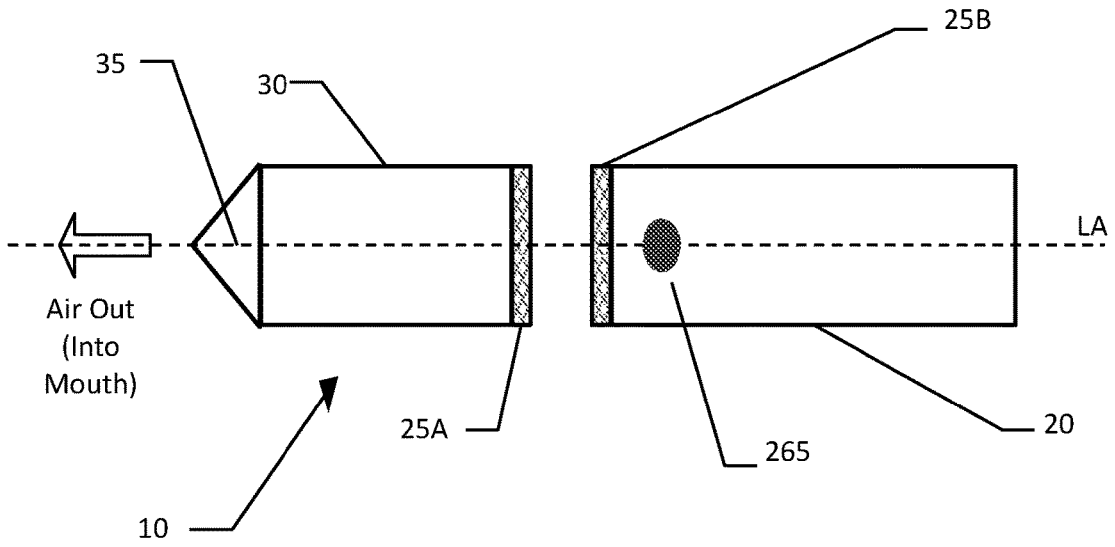
FIG. 1 is a schematic diagram of an electronic aerosol or vapor provision system (EVPS) in accordance with some embodiments of the disclosure.

An electronic aerosol provision system and method are disclosed. In the following description, a number of specific details are presented in order to provide a thorough understanding of the embodiments of the present disclosure. It will be apparent, however, to a person skilled in the art that these specific details need not be employed to practice: embodiments of the present disclosure. Conversely, specific details known to the person skilled in the art are omitted for the purposes of clarity where appropriate.

As described above, the present disclosure relates to an aerosol provision system (e.g., a non-combustible aerosol provision system) or electronic vapor provision system (EVPS), such as an e-cigarette. Throughout the following description the term "e-cigarette" is sometimes used but this term may be used interchangeably with (electronic) aerosol or vapor provision system. Similarly the terms 'vapor' and 'aerosol' are referred to equivalently herein.

Generally, the electronic vapor or aerosol provision system may be an electronic cigarette, also known as a vaping device or electronic nicotine delivery system (END), although it is noted that the presence of nicotine in the aerosolizable material is not a requirement. In some embodiments, a non-combustible aerosol provision system is a tobacco heating system, also known as a heat-not-burn system. In some embodiments, the non-combustible aerosol provision system is a hybrid system to generate aerosol using a combination of aerosolizable materials, one or a plurality of which may be heated. Each of the aerosolizable materials may be, for example, in the form of a solid, liquid, or gel, and may or may not contain nicotine. In some embodiments, the hybrid system comprises a liquid or gel aerosolizable material and a solid aerosolizable material. The solid aerosolizable material may comprise, for example, tobacco or a non-tobacco product. Meanwhile in some embodiments, the non-combustible aerosol provision system generates a vapor or aerosol from one or more such aerosolizable materials.

Typically, the non-combustible aerosol provision system may comprise a non-combustible aerosol provision device and an article for use with the non-combustible aerosol provision system. However, it is envisaged that articles which themselves comprise a means for powering an aerosol generating component may themselves form the non-combustible aerosol provision system. In one embodiment, the non-combustible aerosol provision device may comprise a power source and a controller. The power source may be an electric power source or an exothermic power source. In one embodiment, the exothermic power source comprises a carbon substrate which may be energized so as to distribute power in the form of heat to an aerosolizable material or heat transfer material in proximity to the exothermic power source. In one embodiment, the power source, such as an exothermic power source, is provided in the article so as to form the non-combustible aerosol provision. In one embodiment, the article for use with the non-combustible aerosol provision device may comprise an aerosolizable material.

In some embodiments, the aerosol generating component is a heater capable of interacting with the aerosolizable material so as to release one or more volatiles from the aerosolizable material to form an aerosol. In one embodiment, the aerosol generating component is capable of generating an aerosol from the aerosolizable material without heating. For example, the aerosol generating component may be capable of generating an aerosol from the aerosolizable material without applying heat thereto, for example via one or more of vibrational, mechanical, pressurization, or electrostatic means.

In some embodiments, the aerosolizable material may comprise an active material, an aerosol forming material, and one or more functional materials. The active material may comprise nicotine (optionally contained in tobacco or a tobacco derivative) or one or more other non-olfactory physiologically active materials. A non-olfactory physiologically active material is a material which is included in the aerosolizable material in order to achieve a physiological response other than olfactory perception. The aerosol forming material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate. The one or more functional materials may comprise one or more of flavors, carriers, pH regulators, stabilizers, or antioxidants.

In some embodiments, the article for use with the non-combustible aerosol provision device may comprise aerosolizable material or an area for receiving aerosolizable material. In one embodiment, the article for use with the non-combustible aerosol provision device may comprise a mouthpiece. The area for receiving aerosolizable material may be a storage area for storing aerosolizable material. For example, the storage area may be a reservoir. In one embodiment, the area for receiving aerosolizable material may be separate from, or combined with, an aerosol generating area.

Referring now to the drawings, wherein like reference numerals designate identical or corresponding parts throughout the several views, FIG. 1 is a schematic diagram of an electronic vapor or aerosol provision system (EVPS) such as an e-cigarette 10 in accordance with some embodiments of the disclosure (not to scale). The e-cigarette has a generally cylindrical shape, extending along a longitudinal axis indicated by dashed line LA, and comprises two main components, namely a body 20 and a cartomizer 30. The cartomizer includes an internal chamber containing a reservoir of a payload such as for example a liquid comprising nicotine, a vaporizer (such as a heater), and a mouthpiece 35. References to 'nicotine' hereafter will be understood to be merely exemplary and can be substituted with any suitable active ingredient. References to 'liquid' as a payload hereafter will be understood to be merely exemplary and can be substituted with any suitable payload such as botanical matter (for example tobacco that is to be heated rather than burned), or a gel comprising an active ingredient or flavoring. The reservoir may be a foam matrix or any other structure for retaining the liquid until such time that it is required to be delivered to the vaporizer. In the case of a liquid or flowing payload, the vaporizer is for vaporizing the liquid, and the cartomizer 30 may further include a wick or similar facility to transport a small amount of liquid from the reservoir to a vaporizing location on or adjacent the vaporizer. In the following, a heater is used as a specific example of a vaporizer. However, it will be appreciated that other forms of vaporizer (for example, those which utilize ultrasonic waves) could also be used and it will also be appreciated that the type of vaporizer used may also depend on the type of payload to be vaporized.

The body 20 includes a re-chargeable cell or battery to provide power to the e-cigarette and a circuit board for generally controlling the e-cigarette. When the heater receives power from the battery, as controlled by the circuit board, the heater vaporizes the liquid and this vapor is then inhaled by a user through the mouthpiece 35. In some specific embodiments the body is further provided with a manual activation device 265, e.g. a button, switch, or touch sensor located on the outside of the body.

The body 20 and cartomizer 30 may be detachable from one another by separating in a direction parallel to the longitudinal axis LA, as shown in FIG. 1, but are joined together when the device 10 is in use by a connection, indicated schematically in FIG. 1 as 25A and 25B, to provide mechanical and electrical connectivity between the body 20 and the cartomizer 30. The electrical connector 25B on the body 20 that is used to connect to the cartomizer 30 also serves as a socket for connecting a charging device (not shown) when the body 20 is detached from the cartomizer 30. The other end of the charging device may be plugged into a USB socket to re-charge the cell in the body 20 of the e-cigarette 10. In other implementations, a cable may be provided for direct connection between the electrical connector 25B on the body 20 and a USB socket.

The e-cigarette 10 is provided with one or more holes (not shown in FIG. 1) for air inlets. These holes connect to an air passage through the e-cigarette 10 to the mouthpiece 35. When a user inhales through the mouthpiece 35, air is drawn into this air passage through the one or more air inlet holes, which are suitably located on the outside of the e-cigarette. When the heater is activated to vaporize the nicotine from the cartridge, the airflow passes through, and combines with, the generated vapor, and this combination of airflow and generated vapor then passes out of the mouthpiece 35 to be inhaled by a user. Except in single-use devices, the cartomizer 30 may be detached from the body 20 and disposed of when the supply of liquid is exhausted (and replaced with another cartomizer if so desired).

It will be appreciated that the e-cigarette 10 shown in FIG. 1 is presented by way of example, and various other implementations can be adopted. For example, in some embodiments, the cartomizer 30 is provided as two separable components, namely a cartridge comprising the liquid reservoir and mouthpiece (which can be replaced when the liquid from the reservoir is exhausted), and a vaporizer comprising a heater (which is generally retained). As another example, the charging facility may connect to an additional or alternative power source, such as a car cigarette lighter.

Figure 2:
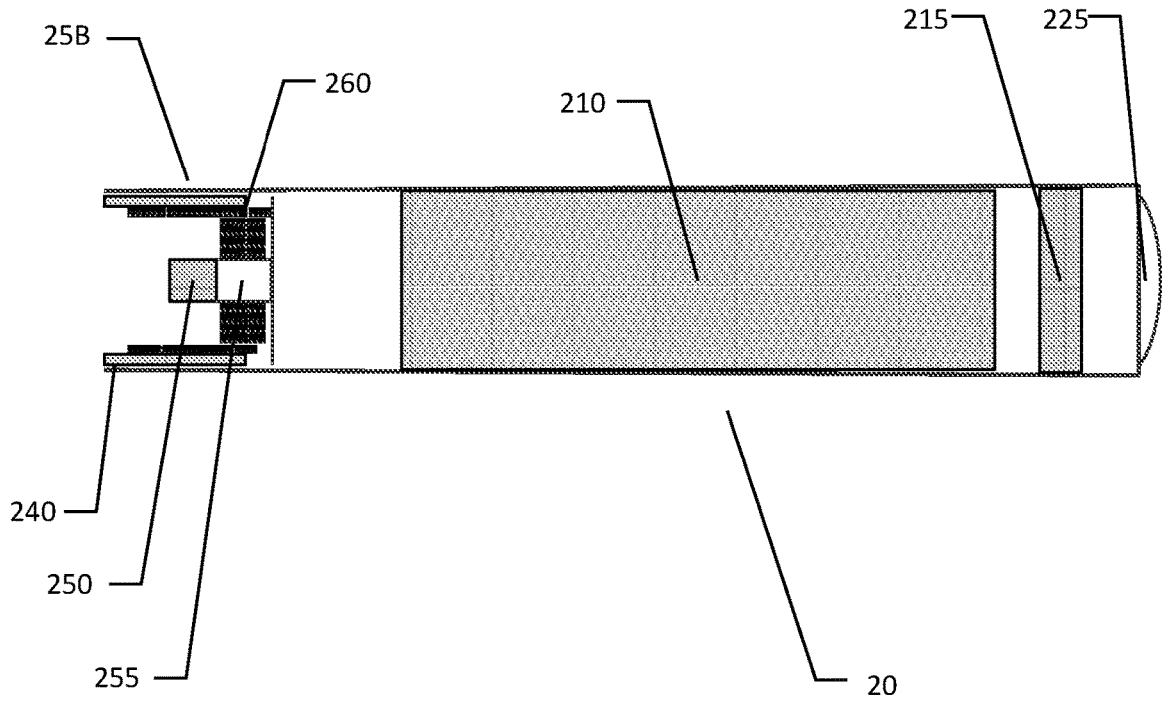
FIG. 2 is a schematic diagram of the body of the EVPS of FIG. 1 in accordance with some embodiments of the disclosure.

FIG. 2 is a schematic (simplified) diagram of the body 20 of the e-cigarette 10 of FIG. 1 in accordance with some embodiments of the disclosure. FIG. 2 can generally be regarded as a cross-section in a plane through the longitudinal axis LA of the e-cigarette 10. Note that various components and details of the body, e.g., such as wiring and more complex shaping, have been omitted from FIG. 2 for reasons of clarity.

The body 20 includes a battery or cell 210 for powering the e-cigarette 10 in response to a user activation of the device. Additionally, the body 20 includes a control unit (not shown in FIG. 2), for example a chip such as an application specific integrated circuit (ASIC) or microcontroller, for controlling the e-cigarette 10. The microcontroller or ASIC includes a CPU or micro-processor. The operations of the CPU and other electronic components are generally controlled at least in part by software programs running on the CPU (or other component). Such software programs may be stored in non-volatile memory, such as ROM, which can be integrated into the microcontroller itself, or provided as a separate component. The CPU may access the ROM to load and execute individual software programs as and when required. The microcontroller also contains appropriate communications interfaces (and control software) for communicating as appropriate with other devices in the body 10.

The body 20 further includes a cap 225 to seal and protect the far (distal) end of the e-cigarette 10. Typically, there is an air inlet hole provided in or adjacent to the cap 225 to allow air to enter the body 20 when a user inhales on the mouthpiece 35. The control unit or ASIC may be positioned alongside or at one end of the battery 210. In some embodiments, the ASIC is attached to a sensor unit 215 to detect an inhalation on mouthpiece 35 (or alternatively the sensor unit 215 may be provided on the ASIC itself). An air path is provided from the air inlet through the e-cigarette, past the airflow sensor 215 and the heater (in the vaporizer or cartomizer 30), to the mouthpiece 35. Thus, when a user inhales on the mouthpiece of the e-cigarette, the CPU detects such inhalation based on information from the airflow sensor 215.

At the opposite end of the body 20 from the cap 225 is the connector 25B for joining the body 20 to the cartomizer 30. The connector 25B provides mechanical and electrical connectivity between the body 20 and the cartomizer 30. The connector 25B includes a body connector 240, which is metallic (silver-plated in some embodiments) to serve as one terminal for electrical connection (positive or negative) to the cartomizer 30. The connector 25B further includes an electrical contact 250 to provide a second terminal for electrical connection to the cartomizer 30 of opposite polarity to the first terminal, namely body connector 240. The electrical contact 250 is mounted on a coil spring 255. When the body 20 is attached to the cartomizer 30, the connector 25A on the cartomizer 30 pushes against the electrical contact 250 in such a manner as to compress the coil spring in an axial direction, e.g., in a direction parallel to (co-aligned with) the longitudinal axis LA. In view of the resilient nature of the spring 255, this compression biases the spring 255 to expand, which has the effect of pushing the electrical contact 250 firmly against connector 25A of the cartomizer 30, thereby helping to ensure good electrical connectivity between the body 20 and the cartomizer 30. The body connector 240 and the electrical contact 250 are separated by a trestle 260, which is made of a non-conductor (such as plastic) to provide good insulation between the two electrical terminals. The trestle 260 is shaped to assist with the mutual mechanical engagement of connectors 25A and 25B.

As mentioned above, a button 265, which represents a form of manual activation device 265, may be located on the outer housing of the body 20. The button 265 may be implemented using any appropriate mechanism which is operable to be manually activated by the user—for example, as a mechanical button or switch, a capacitive or resistive touch sensor, and so on. It will also be appreciated that the manual activation device 265 may be located on the outer housing of the cartomizer 30, rather than the outer housing of the body 20, in which case, the manual activation device 265 may be attached to the ASIC via the connections 25A, 25B. The button 265 might also be located at the end of the body 20, in place of (or in addition to) cap 225.

Figure 3:
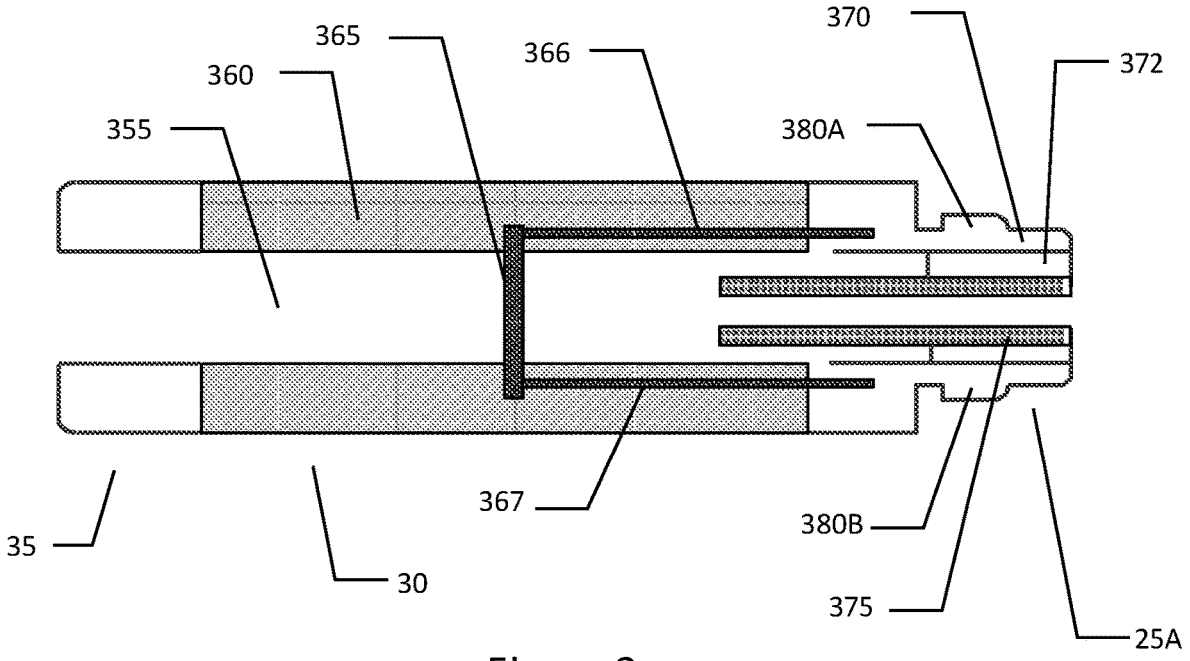
FIG. 3 is a schematic diagram of the cartomizer of the EVPS of FIG. 1 in accordance with some embodiments of the disclosure.

FIG. 3 is a schematic diagram of the cartomizer 30 of the e-cigarette 10 of FIG. 1 in accordance with some embodiments of the disclosure. FIG. 3 can generally be regarded as a cross-section in a plane through the longitudinal axis LA of the e-cigarette 10. Note that various components and details of the cartomizer 30, such as wiring and more complex shaping, have been omitted from FIG. 3 for reasons of clarity.

The cartomizer 30 includes an air passage 355 extending along the central (longitudinal) axis of the cartomizer 30 from the mouthpiece 35 to the connector 25A for joining the cartomizer 30 to the body 20. A reservoir of liquid 360 is provided around the air passage 335. This reservoir 360 may be implemented, for example, by providing cotton or foam soaked in liquid. The cartomizer 30 also includes a heater 365 for heating liquid from reservoir 360 to generate vapor to flow through air passage 355 and out through mouthpiece 35 in response to a user inhaling on the e-cigarette 10. The heater 365 is powered through lines 366 and 367, which are in turn connected to opposing polarities (positive and negative, or vice versa) of the battery 210 of the main body 20 via connector 25A (the details of the wiring between the power lines 366 and 367 and connector 25A are omitted from FIG. 3).

The connector 25A includes an inner electrode 375, which may be silver-plated or made of some other suitable metal or conducting material. When the cartomizer 30 is connected to the body 20, the inner electrode 375 contacts the electrical contact 250 of the body 20 to provide a first electrical path between the cartomizer 30 and the body 20. In particular, as the connectors 25A and 25B are engaged, the inner electrode 375 pushes against the electrical contact 250 so as to compress the coil spring 255, thereby helping to ensure good electrical contact between the inner electrode 375 and the electrical contact 250.

The inner electrode 375 is surrounded by an insulating ring 372, which may be made of plastic, rubber, silicone, or any other suitable material. The insulating ring is surrounded by the cartomizer connector 370, which may be silver-plated or made of some other suitable metal or conducting material. When the cartomizer 30 is connected to the body 20, the cartomizer connector 370 contacts the body connector 240 of the body 20 to provide a second electrical path between the cartomizer 30 and the body 20. In other words, the inner electrode 375 and the cartomizer connector 370 serve as positive and negative terminals (or vice versa) for supplying power from the battery 210 in the body 20 to the heater 365 in the cartomizer 30 via supply lines 366 and 367 as appropriate.

The cartomizer connector 370 is provided with two lugs or tabs 380A, 380B, which extend in opposite directions away from the longitudinal axis of the e-cigarette 10. These tabs are used to provide a bayonet fitting in conjunction with the body connector 240 for connecting the cartomizer 30 to the body 20. This bayonet fitting provides a secure and robust connection between the cartomizer 30 and the body 20, so that the cartomizer and body are held in a fixed position relative to one another, with minimal wobble or flexing, and the likelihood of any accidental disconnection is very small. At the same time, the bayonet fitting provides simple and rapid connection and disconnection by an insertion followed by a rotation for connection, and a rotation (in the reverse direction) followed by withdrawal for disconnection. It will be appreciated that other embodiments may use a different form of connection between the body 20 and the cartomizer 30, such as a snap fit or a screw connection.

Figure 4:
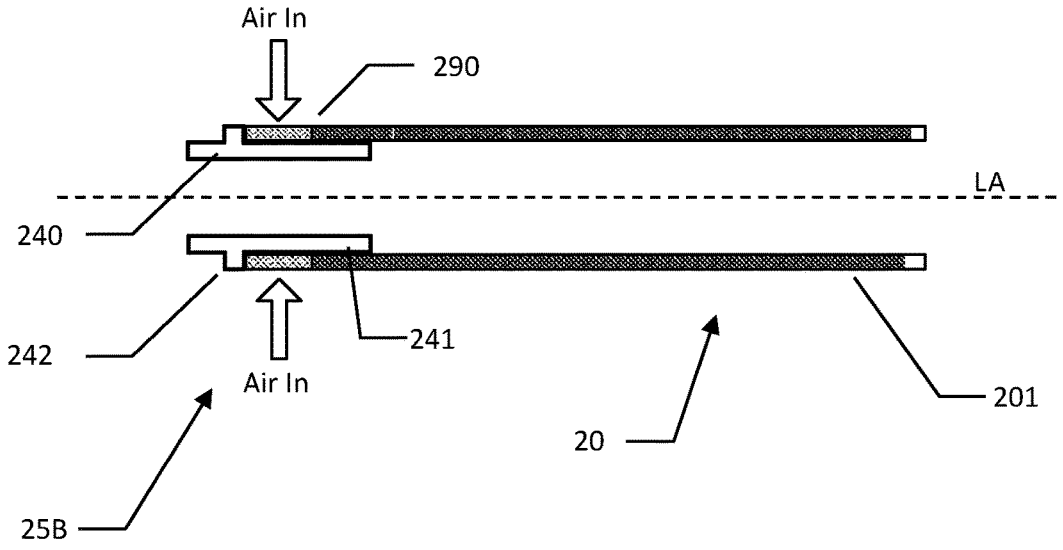
FIG. 4 is a schematic diagram of the connector at the end of the body of the EVPS in accordance with some embodiments of the disclosure.

FIG. 4 is a schematic diagram of certain details of the connector 25B at the end of the body 20 in accordance with some embodiments of the disclosure (but omitting for clarity most of the internal structure of the connector as shown in FIG. 2, such as trestle 260). In particular, FIG. 4 shows the external housing 201 of the body 20, which generally has the form of a cylindrical tube. This external housing 201 may comprise, for example, an inner tube of metal with an outer covering of paper or similar. The external housing 201 may also comprise the manual activation device 265 (not shown in FIG. 4) so that the manual activation device 265 is easily accessible to the user.

The body connector 240 extends from this external housing 201 of the body 20. The body connector 240 as shown in FIG. 4 comprises two main portions, a shaft portion 241 in the shape of a hollow cylindrical tube, which is sized to fit just inside the external housing 201 of the body 20, and a lip portion 242 which is directed in a radially outward direction, away from the main longitudinal axis (LA) of the e-cigarette. Surrounding the shaft portion 241 of the body connector 240, where the shaft portion does not overlap with the external housing 201, is a collar or sleeve 290, which is again in a shape of a cylindrical tube. The collar 290 is retained between the lip portion 242 of the body connector 240 and the external housing 201 of the body, which together prevent movement of the collar 290 in an axial direction (e.g., parallel to axis LA). However, collar 290 is free to rotate around the shaft portion 241 (and hence also axis LA).

As mentioned above, the cap 225 is provided with an air inlet hole to allow air to flow when a user inhales on the mouthpiece 35. However, in some embodiments the majority of air that enters the device when a user inhales flows through collar 290 and body connector 240 as indicated by the two arrows in FIG. 4.

Figure 6:
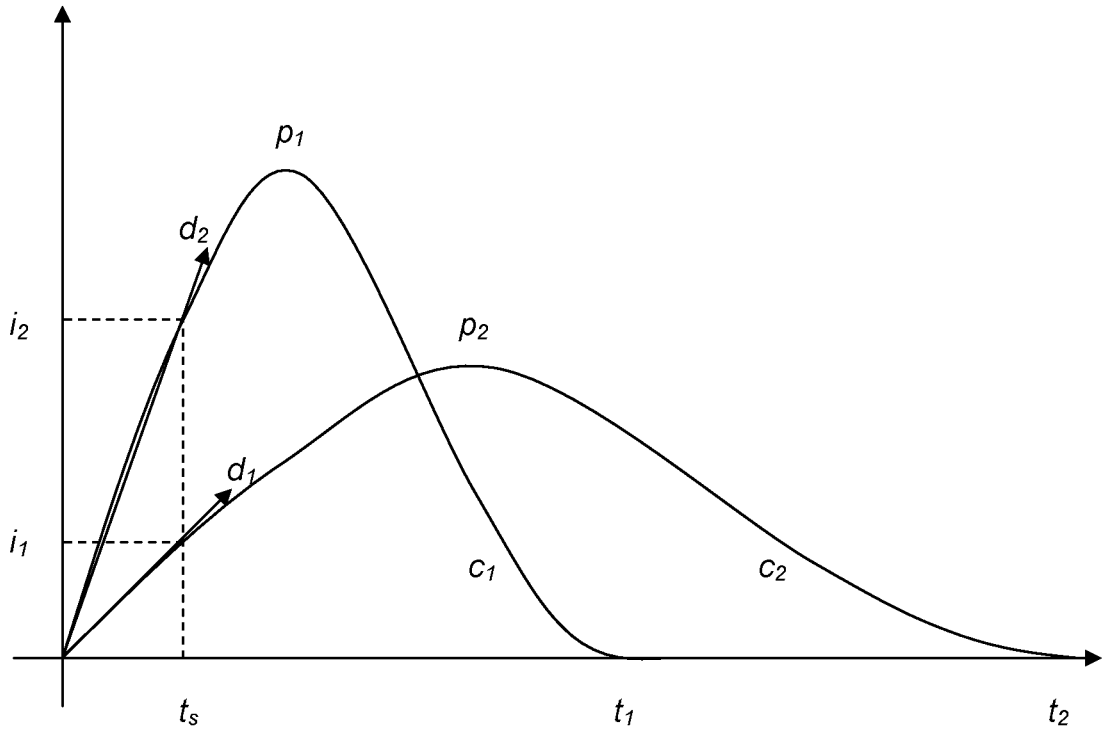
FIG. 6 is airflow profiles of two different inhalations in accordance with some embodiments of the disclosure.
Figure 7:
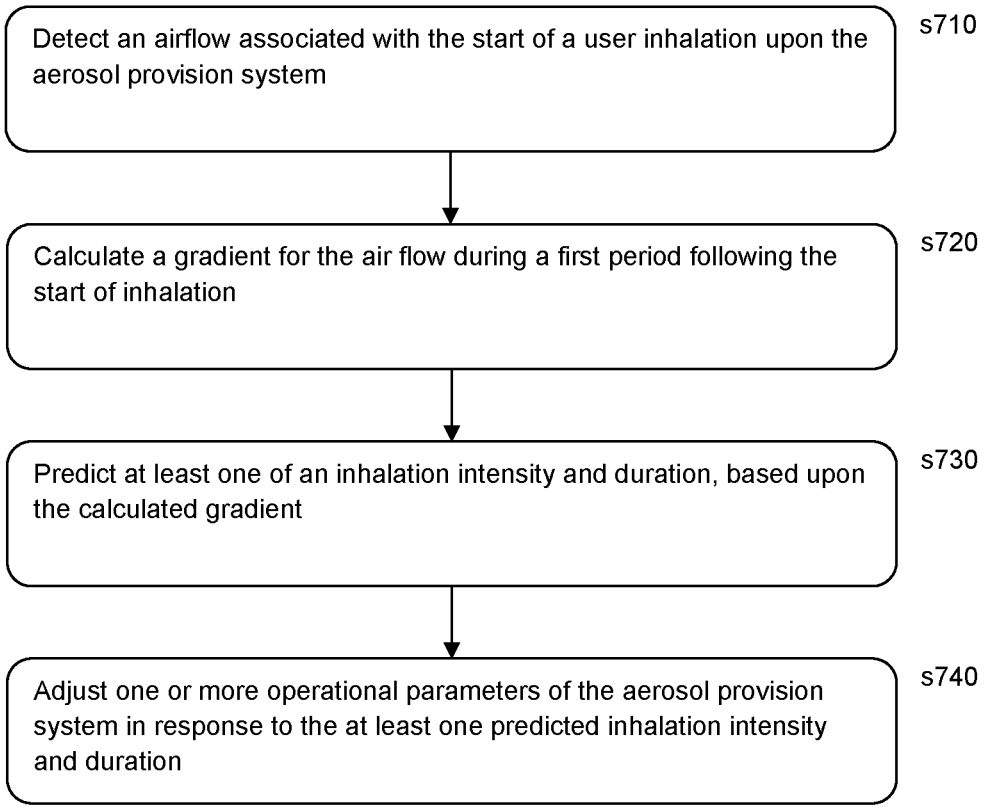
FIG. 7 is a flowchart of a method of user characterization.

Referring now to FIGS. 6, which illustrates the airflow profiles ($c_1$, $c_2$) of two different inhalations, and FIG. 7, which is a flow diagram, then in an embodiment of the present disclosure a method of user characterization is provided for an aerosol provision system configured to generate aerosol from an aerosol generating material for user inhalation (such as described previously herein).

In step s710, the method comprises detecting an airflow ($i_1$, $i_2$) associated with the start of a user inhalation upon the aerosol provision system;

in step s720, the method comprises calculating a gradient ($d_1$, $d_2$) for the air flow during a first period ($t_s$) following the start of inhalation;

in step s730, the method comprises predicting at least one of an inhalation intensity ($p_1$, $p_2$) and duration ($t_1$, $t_2$), based upon the calculated gradient; and in step s740, the method comprises adjusting one or more operational parameters of the aerosol provision system in response to the at least one predicted inhalation intensity and duration.

In step s710, the airflow can be indicated by any suitable proxy, such as dynamic pressure drop within the EVPS, or an actual airspeed or flow or volume measure. Furthermore, the gradient or prediction may optionally be carried out on the basis of the values from the proxy measure without conversion to a notional airflow value. As such, it will be appreciated that for the purposes of the method, the actual airflow and any proxy for it may be considered equivalent.

In step s710, the start of user inhalation may be understood to be the point at which the EVPS normally detects that inhalation has commenced and normally responds by commencing the process of generating an aerosol. Where the EVPS detects potential inhalations at a lower airflow threshold (e.g., to pre-heat the heater) prior to actual inhalation being confirmed by a higher airflow threshold, then the start of user inhalation may optionally be taken to begin at the lower threshold once the higher threshold has been reached.

The airflow value (or its proxy) ($i_1$, $i_2$) may be sampled at a sampling time $t_s$ after the start of user inhalation. Optionally the value may be sampled at a plurality of sampling times.

In the second step, the gradient ($d_1$, $d_2$) may be calculated to a first approximation from the airflow value and sampling time as $d_1=i_1/t_s$, $d_2=i_2/t_s$. Optionally, where a plurality of samples were taken, a parametric fit may be generated that incorporates this value/time relationship and hence the gradient as it evolves over the first period $t_s$.

In step s730 of predicting at least one of an inhalation intensity and duration based on the gradient, it can be understood from the inhalation profiles $c_1$ and $c_2$ of FIG. 6 that, for a finite inhalation capacity of the user, the initial gradient of the inhalation can be predictive of the overall intensity (e.g., peak airflow) of the inhalation, and its duration, as the integral of a curve extrapolated from the gradient cannot exceed the inhalation capacity of the user.

Hence fitting a curve to the initial gradient that has in integral equal to the inhalation capacity of the user provides a good first approximation for a prediction of the inhalation profile that has just commenced. In particular, the peak of the curve is predictive of the peak airflow ($p_1$, $p_2$) and the end of the curve is predictive of the duration ($t_1$, $t_2$).

It can be understood that an inhalation capacity of the user is not necessarily the same as the lung capacity of the user; that is to say, the user may not habitually take an inhalation that fully inflates their lungs. Hence optionally, during a calibration period, or as an ongoing measurement process, the total inhalation capacity of the user over a number of sampled inhalation actions may be analyzed to determine an average inhalation capacity for use as the target integral.

To a second approximation, a plurality of inhalation capacities of the user may be characterized. Hence, for example inhalation action $c_1$ may be characteristic of a short, intense draw on the EVPS, whilst inhalation action $c_2$ may be characteristic of a longer, more relaxed draw that in this example results in a larger overall volume being inhaled. Hence, a more accurate curve may be estimated if different average inhalation capacities are assumed for these types of inhalation.

Such a plurality of inhalation capacities may be determined for example by determining an average capacity for gradients above and below a threshold gradient, which may be set at manufacture, or via a user interface, or may be determined by analysis of the user's behavior. In this latter case, for example, initially a first average capacity may be determined from N measured inhalations, together with the associated variance. If the variance is above a threshold value, this is indicative that more accurate capacity estimates are needed or possible, and the N measured inhalations may be split in to two or more groups based on the respective gradient to generate two or more separate averages and associated variances, with the split(s) being selected to minimize overall the resulting variances. This will find a gradient threshold(s) appropriate to the behavior of the user. Clearly, it will be appreciated that the process may be repeated to update the average capacities if one or more variances for a given initial gradient or gradient range increases above the threshold again, or similarly may be applied recursively to a subset of gradients if one range of gradients in particular shows high variance compared to others. Other partitioning methods may also be considered for a set of N measure inhalations, such as K-means clustering, where K is the number of desired inhalation capacities to be modelled.

In any event, when a plurality of inhalation capacities of the user have been characterized, then the one appropriate to the currently estimated gradient may be used as the target integration value for the curve fitted to the gradient at time $t_s$.

The inhalation intensity (typically the peak inhalation p1, p2, or optionally the mean over the duration of inhalation or over a fixed period preceding and/or following the peak) may then be predicted, or the duration $t_1$, $t_2$ at which the current assumed inhalation capacity is reached.

Hence, more generally an EVPS may estimate an average inhalation capacity of the user, and predicting at least one of an inhalation intensity and duration comprises estimating when the average inhalation capacity of the user will be reached based upon the calculated gradient of the air flow. Meanwhile, predicting an inhalation duration may comprise fitting an inhalation profile to the calculated gradient, the integral of the inhalation profile being equal to the estimated average inhalation capacity of the user, with the resulting duration of the profile predicting the inhalation duration, and the resulting position of the peak of the profile predicting the inhalation intensity (and timing). Further, as noted above, a respective average inhalation capacity may be estimates for two or more different ranges of calculated gradient, and the step of predicting at least one of an inhalation intensity and duration comprises selecting the estimated average inhalation capacity corresponding to the current calculated gradient.

Finally, in step s740, one or more operational parameters of the aerosol provision system can be adjusted in response to the at least one predicted inhalation intensity and duration.

These adjustments may be made to improve the delivery of aerosol to the user, or to improve the efficiency of the EVPS.

Hence, in an embodiment of the disclosure, the step of adjusting one or more operational parameters may comprise setting an end time for the generation of the aerosol responsive to the predicted inhalation duration.

Hence, for example, the heater may shut off (or cool down to below a vaporization temperature) at the predicted duration ($t_1$, $t_2$), or optionally preceding the predicted inhalation duration by a predetermined amount (either a relative amount, such as 5% or 10% earlier, or a fixed amount such as 0.1 s or 0.2 s earlier, by way of non-limiting examples).

This exploits the observation that near the end of the inhalation, the air drawn through the EVPS is unlikely to reach the lungs of the user and so will have no physiological effect; hence vaporizing the active ingredient at this time is a potential waste. Furthermore, stopping vapor generation whilst there is still a residual inhalation enables the remaining generated vapor within the EVPS to still be drawn out of the device, reducing the potential for condensation and clogging of the device from vapor left within it after an inhalation has taken place.

Clearly, if the user is still inhaling on the device at a level above a threshold value at the predicted end time (or at the predetermined preceding moment, as applicable), then the heater may either not deactivate, or reactivate (or heat back up above the vaporization temperature) to maintain or resume supply to the user as appropriate, in the apparent event that the estimate was wrong.

Whether or not the EVPS is adapted to effectively stop vapor generation at a predicted time, optionally the device may be adapted to generate a predetermined amount of aerosol within a predetermined portion of the predicted inhalation duration.

Hence, for example, the device manufacturer may decide that the delivery of a certain amount of active ingredient is ideal for a single inhalation by user. This amount may be provided as a function of generation rate by the EVPS multiplied by time.

Hence given the predicted inhalation duration, a vapor generation rate of the EVPS may be set to deliver the ideal amount of active ingredient to the user over the course of the predicted duration. The generation rate may be modified by one or more of change of heater temperature, duty cycle of the heater above or below a vaporization temperature, rate of delivery of payload to the heater for vaporization or aerosolization, and the like.

As noted above, given the predicted inhalation duration, it is also possible to predict a predetermined portion of the predicted inhalation duration, typically an initial period of the inhalation, that is likely to result in vapor being drawn into the lungs. Consequently, the vapor generation rate of the VPS may be adjusted to deliver the ideal amount of active ingredient to the user specifically over this predetermined portion of the inhalation duration.

Thereafter, the EVPS may either continue to deliver a vapor to the user even though this may not be taken into the lungs, or may cease vapor production for the remainder of the inhalation.

Potentially, in one sense whilst ceasing vapor production avoids waste of the active ingredient, a user may find it unsatisfactory if they cannot taste or feel the vapor during the latter part of the inhalation action. Hence, alternatively the EVPS may simply reduce vapor production for the remainder of the inhalation, for example by use of a duty cycle as the heater.

Alternatively or in addition, the EVPS may modify the composition of the generated aerosol at a predetermined point in the predicted inhalation duration. For example, where the device comprises a reservoir of liquid comprising an active ingredient such as nicotine, and a reservoir of liquid comprising a flavoring, the ratio of active ingredient and flavor can be changed between the initial period of inhalation and the latter period preceding the predicted end of the inhalation action. Hence, for example, the EVP's may deliver a high concentration of active ingredient in the initial period that reaches the user's lungs, and then switch to a low concentration of active ingredient and a higher concentration of flavoring for the remaining period where the inhaled air is likely to remain in the user's mouth.

Again it will be appreciated that the changeover point between the initial period and the latter period for such a technique may differ for different inhalation capacities or initial gradients, and so different changeover points may also be associated with respective gradients, gradient ranges, inhalation profiles and the like in a similar manner to the inhalation capacities themselves.

Optionally, in response to the initial gradient ($i_1$, $i_2$) the device may adjust a rate of generation of aerosol responsive to the predicted inhalation intensity. Hence, a 'high' intensity (steep gradient) inhalation implies delivery of a high amount of vapor for a short period (e.g., using high power), whilst a 'low' intensity inhalation implies delivery of a low amount of vapor for a longer period (e.g., using low power). Again, vapor generation may be controlled by temperature, duty cycle, delivery of payload to the heater or any other suitable mechanism.

The rate of generation of aerosol can be further tuned in response to the profile associated with or predicted from the initial gradient, such that it tracks some or all of the predicted intensity of the inhalation. To a first approximation, the rate of generation of aerosol may be increased for a period responsive to when the peak airflow ($p_1$, $p_2$) is predicted to occur. Hence, for example a peak in generation may be provided during a period preceding and/or following this peak and typically also including it.

Of course, the approach implemented by an EVPS may be much simpler; when a steep gradient is detected (e.g., above a predetermined threshold) then a high power is supplied to the heater for a short period of time (e.g., one empirically determined by the manufacturer), and when a shallow gradient is detected (e.g., below a predetermined threshold) then a low power is supplied to the heater for a longer period of time (e.g., one again empirically determined by the manufacturer). Such a system can of then optionally also be subject to any further functional modifications, such as power shut-off in the even that inhalation ceases before the determined period, etc.

With reference to the previously described delivery of active ingredients during a period that ends before the predicted end of the inhalation, in a similar manner the above approach can be used to effectively deliver most of the active ingredient from the start of inhalation until shortly after the predicted peak airflow, where 'most' may be a predetermined proportion and similarly 'shortly' may be a predetermined relative or absolute period.

Again similarly, where the step of predicting comprises predicting when a peak airflow ($p_1$, $p_2$) will occur, then the composition of the aerosol may modified at a point in time responsive to when the peak airflow is predicted to occur. Hence again a rebalancing or transition from active ingredient to flavor may be implemented at this point.

Hence more generally, modifications to the intensity, volume, duration, and composition of the vapor or aerosol may be made responsive to the overall duration of the inhalation, or alternatively or in addition in response to the predicted timing of the peak inhalation. Notably, there may be less variance in the predicted timing of the peak inhalation compared to the overall duration based on the initial gradient, and so modifications based on the peak may be more reliable for the user than hose based on the predicted duration.

It will be appreciated that the above methods may be carried out on conventional hardware suitably adapted as applicable by software instruction or by the inclusion or substitution of dedicated hardware.

Thus, the required adaptation to existing parts of a conventional equivalent device may be implemented in the form of a computer program product comprising processor implementable instructions stored on a non-transitory machine-readable medium such as a floppy disk, optical disk, hard disk, solid state disk, PROM, RAM, flash memory or any combination of these or other storage media, or realized in hardware as an ASIC (application specific integrated circuit) or an FPGA (field programmable gate array) or other configurable circuit suitable to use in adapting the conventional equivalent device. Separately, such a computer program may be transmitted via data signals on a network such as an Ethernet, a wireless network, the Internet, or any combination of these or other networks.

Referring again to FIGS. 1 and 5, the suitably adapted devices may comprise an EVPS 10, either in isolation or in communication with a remote computing device such as a smart phone 100 and/or optionally a remote server.

Hence, in embodiments of the disclosure, a user characterization system comprises an electronic aerosol provision system 10 configured to generate aerosol from an aerosol generating material for user inhalation, as described previously herein, with the EVPS comprising an airflow detector/sensor 215.

The user characterization system comprises a processor operable (for example under suitable software instruction) to detect an airflow associated with the start of the user inhalation upon the aerosol provision system, a gradient captivating processor operable (for example under suitable software instruction) to calculate a gradient for the air flow during a first period following the start of inhalation, a prediction processor operable (for example under suitable software instruction) to predict at least one of an inhalation intensity and duration, based upon the calculated gradient; and a control unit (for example a control processor) operable (for example under suitable software instruction) to cause the adjustment of one or more operational parameters of the aerosol provision system in response to the at least one predicted inhalation intensity and duration.

It will be appreciated that the above processors may in practice be one or more general-purpose processors adapted by software instruction to operate in these respective roles.

It will also be appreciated that the one or processors may be located in the EVPS itself, and/or in the mobile phone and/or remote server.

Similarly the control unit may be located within the EVPS itself or may be located in the mobile phone or server. In these latter cases, the control unit causes the adjustment of parameters by transmitting control commands to the EVPS, in the EVPS comprises a secondary control unit that enacts these commands.

It will be appreciated that embodiments of the above user characterization system may comprise those means required to implement any chosen aspects of the hearing described techniques, including but not limited to:

a processor operable to set an end time for the generation of the aerosol responsive to the predicted inhalation duration, optionally with the end time being set to precede the end of the predicted inhalation duration by a predetermined amount;

the user characterization system being operable to generate a predetermined amount of aerosol within a predetermined portion of the predicted inhalation duration;

the user characterization system being operable to modify the composition of the generated aerosol at a predetermined point in the predicted inhalation duration;

the user characterization system being operable to adjust a rate of generation of aerosol responsive to the predicted inhalation intensity;

the prediction processor being operable to predict when a peak airflow will occur, and the user characterization system being operable to increase the rate of generation of aerosol for a period responsive to when the peak airflow is predicted to occur;

the prediction processor being operable to predict when a peak airflow will occur, and the user characterization system being operable to modify the composition of the aerosol at a point in time responsive to when the peak airflow is predicted to occur;

the prediction processor being operable to estimate an average inhalation capacity of the user, and to estimate when the average inhalation capacity of the user will be reached based upon the calculated gradient of the air flow, the prediction processor optionally being operable to fit an inhalation profile to the calculated gradient, the integral of the inhalation profile being equal to the estimated average inhalation capacity of the user, where the resulting duration of the profile predicts the inhalation duration;

the prediction processor optionally being operable to fit an inhalation profile to the calculated gradient, the integral of the inhalation profile being equal to the estimated average inhalation capacity of the user, where the resulting position of the peak of the profile predicts the inhalation intensity; and the prediction processor optionally being operable to estimate a respective average inhalation capacity for two or more different ranges of calculated gradient, and when predicting at least one of an inhalation intensity and duration, select the estimated average inhalation capacity corresponding to the current calculated gradient.

Referring again to FIG. 1, as noted above a user characterization system may be a self-contained unit (e.g., an EVPS 10, commonly referred to as an e-cigarette, even if the device itself does not necessarily conform to the shape or dimensions of a conventional cigarette). Such an e-cigarette may comprise an airflow measuring means, a processing means and optionally one or more feedback means such as haptic, audio or light or display means.

Figure 5:
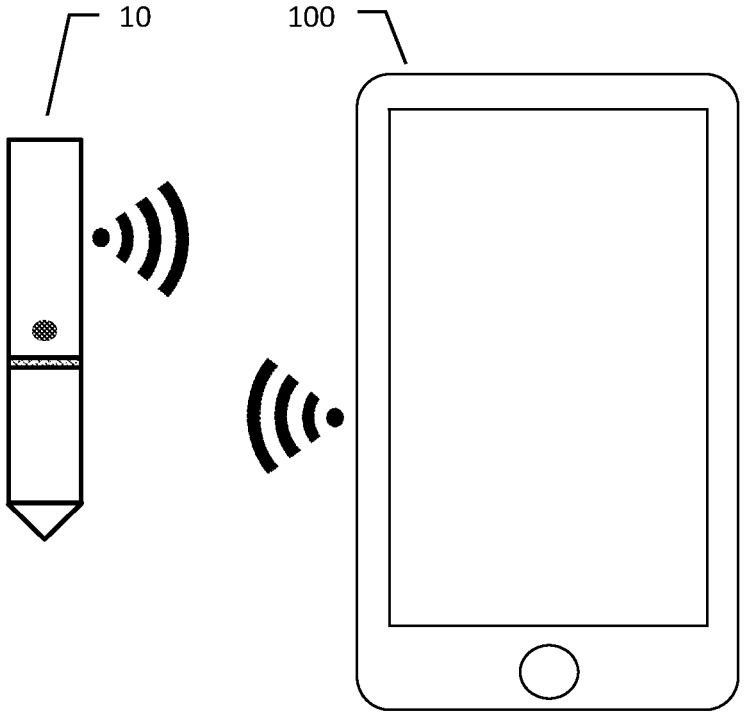
FIG. 5 illustrates a system comprising the EVPS and a remote device in accordance with some embodiments of the disclosure.

In embodiments, referring to FIG. 5, then as also noted above a user characterization system may comprise two components, such as an EVPS or e-cigarette 10 and a mobile phone or similar device (such as a tablet) 100 operable to communicate with the e-cigarette (for example to at least receive data from the e-cigarette), for example via Bluetooth®.

The mobile phone may then comprise the processing means and one or more feedback means such as haptic, audio or light or display means, alternatively or in addition to those of the e-cigarette.

Optionally a user characterization system may comprise an EVPS e-cigarette 10 operable to communicate with a mobile phone 100, in which the mobile phone stores one or more parameters or other data (such as data characteristic of one or more aspects of usage by the user) for the EVPS, and receives such parameters or data from the e-cigarette. The phone may then optionally perform processing on such parameters or data and either return processed data or instructions to the EVPS, display a result to the user (or perform another action) or forward processed unprocessed parameters or data on to a remote server.

Optionally the mobile phone or the EVPS itself may be operable to wirelessly access data associated with an account of the user at such a remote server, again as noted previously herein.

In a variant embodiment of the disclosure, a first EVPS of a user may communicate some or all of its user settings to another EVPS. The user settings may comprise settings related to an implementation of the above disclosed methods, such as data characteristic of user behavior, or data relating to modification of the EVPS operation.

Such data may be relayed between devices either directly (e.g., via a Bluetooth® or near-field communication) or via one or more intermediary devices, such as a mobile phone owned by the user of the two devices or a server on which the user has an account.

In this way, a user may easily share the data from one device to another, for example if the user has two EVPS devices, or if the user wishes to replace one EVPS device with another without losing accumulated personalization data.

Optionally in this embodiment, where the second EVPS differs in type from the first EVPS (for example by having a different default power level, or heating efficiency), then a conversion factor or look-up table for converting operational parameters from the first EVPS to the second EVPS may be employed. This may be provided in software or firmware of the second EVPS, and identify the first EVPS and hence the appropriate conversions when making direct communication (or where data is relayed without change via an intermediary such as a phone). Alternatively or in addition an app on the phone may provide the conversion, optionally downloading the relevant conversions in response to the identity of the first and second EVPS. Again, alternatively or in addition a remote server may provide the conversion, in response to the identity of the first and second EVPS as associated with a user's account.

The foregoing discussion discloses and describes merely exemplary embodiments of the present disclosure. As will be understood by those skilled in the art, the present disclosure may be embodied in other specific forms without departing from the essential characteristics thereof. Accordingly, the disclosure of the present disclosure is intended to be illustrative, but not limiting of the scope of the disclosure, as well as other claims. The disclosure, including any readily discernible variants of the teachings herein, defines, in part, the scope of the foregoing claim terminology such that no disclosed subject matter is dedicated to the public.

What is claimed is:

1. A method of user characterization for an aerosol provision system configured to generate aerosol from an aerosol generating material for user inhalation, the method comprising:

detecting an airflow associated with a start of a user inhalation upon the aerosol provision system;

calculating a gradient for the airflow during a first period following the start of inhalation;

predicting at least one of an inhalation intensity and an inhalation duration, based upon the calculated gradient; and adjusting one or more operational parameters of the aerosol provision system in response to the at least one of the predicted inhalation intensity and the predicted inhalation duration;

wherein adjusting one or more operational parameters comprises setting an end time for the generation of the aerosol responsive to the predicted inhalation duration, wherein the end time is set to precede an end of the predicted inhalation duration by a predetermined amount.

2. The method of claim 1, further comprising the step of generating a predetermined amount of aerosol within a predetermined portion of the predicted inhalation duration.

3. The method of claim 1, further comprising the step of modifying the composition of the generated aerosol at a predetermined point in the predicted inhalation duration.

4. The method of claim 1, wherein the step of adjusting one or more operational parameters comprises:

adjusting a rate of generation of aerosol responsive to the predicted inhalation intensity.

5. The method of claim 4, wherein the step of predicting an inhalation intensity further comprises predicting when a peak airflow will occur, and the rate of generation of aerosol is increased for a period responsive to when the peak airflow is predicted to occur.

6. The method of claim 4, wherein the step of predicting an inhalation intensity further comprises predicting when a peak airflow will occur, and the composition of the aerosol is modified at a point in time responsive to when the peak airflow is predicted to occur.

7. The method of claim 1, further comprising the step of:

estimating an average inhalation capacity of the user; and wherein predicting at least one of the inhalation intensity and the inhalation duration comprises estimating when the average inhalation capacity of the user will be reached based upon the calculated gradient of the air flow.

8. The method of claim 7, wherein predicting the inhalation duration comprises:

fitting an inhalation profile to the calculated gradient, an integral of the inhalation profile being equal to the estimated average inhalation capacity of the user; and wherein a resulting duration of the profile predicts the inhalation duration.

9. The method of claim 7, wherein predicting an inhalation intensity comprises:

fitting an inhalation profile to the calculated gradient, an integral of the inhalation profile being equal to the estimated average inhalation capacity of the user; and wherein a resulting position of the peak of the profile predicts the inhalation intensity.

10. The method of claim 7, wherein estimating the average inhalation capacity of the user comprises:

estimating a respective average inhalation capacity for two or more different ranges of the calculated gradient, and predicting at least one of the inhalation intensity and the inhalation duration comprises selecting the estimated average inhalation capacity corresponding to the current calculated gradient.

11. A computer program comprising computer executable instructions adapted to cause a computer system to perform the method of claim 1.

12. A user characterization system comprising an electronic aerosol provision system configured to generate aerosol from an aerosol generating material for a user inhalation and in turn comprising an airflow detector, the user characterization system comprising:

a processor operable to detect an airflow associated with a start of the user inhalation upon the aerosol provision system;

a gradient captivating processor operable to calculate a gradient for the airflow during a first period following the start of inhalation;

a prediction processor operable to predict at least one of an inhalation intensity and an inhalation duration, based upon the calculated gradient; and a control unit operable to cause an adjustment of one or more operational parameters of the aerosol provision system in response to the at least one predicted inhalation intensity and predicted inhalation duration;

wherein the control unit is operable for setting an end time for the generation of the aerosol responsive to the predicted inhalation duration, wherein the end time is set to precede an end of the predicted inhalation duration by a predetermined amount.

13. The user characterization system of claim 12, wherein one or more operational parameters of the aerosol provision system are adjusted to generate a predetermined amount of aerosol within a predetermined portion of the predicted inhalation duration.

14. The user characterization system of claim 12, wherein one or more operational parameters of the aerosol provision system are adjusted to modify the composition of the generated aerosol at a predetermined point in the predicted inhalation duration.

15. The user characterization system of claim 12, wherein a rate of generation of aerosol is adjusted responsive to the predicted inhalation intensity.

16. The user characterization system of claim 12, wherein the prediction processor is operable to estimate an average inhalation capacity of the user; and the prediction processor operable to predict at least one of the inhalation intensity and the inhalation duration comprises estimating when the average inhalation capacity of the user will be reached based upon the calculated gradient of the airflow.

17. A method of user characterization for an aerosol provision system configured to generate aerosol from an aerosol generating material for user inhalation, the method comprising:

detecting an airflow associated with a start of a user inhalation upon the aerosol provision system;

calculating a gradient for the airflow during a first period following the start of inhalation;

predicting at least one of an inhalation intensity and an inhalation duration, based upon the calculated gradient; and adjusting one or more operational parameters of the aerosol provision system in response to the at least one of the predicted inhalation intensity and the predicted inhalation duration; and further comprising the step of modifying the composition of the generated aerosol at a predetermined point in the predicted inhalation duration.

18. A method of user characterization for an aerosol provision system configured to generate aerosol from an aerosol generating material for user inhalation, the method comprising:

detecting an airflow associated with a start of a user inhalation upon the aerosol provision system;

calculating a gradient for the airflow during a first period following the start of inhalation;

predicting at least one of an inhalation intensity and an inhalation duration, based upon the calculated gradient; and adjusting one or more operational parameters of the aerosol provision system in response to the at least one of the predicted inhalation intensity and the predicted inhalation duration;

wherein the step of adjusting one or more operational parameters comprises adjusting a rate of generation of aerosol responsive to the predicted inhalation intensity, wherein the step of predicting an inhalation intensity further comprises predicting when a peak airflow will occur; and wherein the rate of generation of aerosol is increased for a period responsive to when the peak airflow is predicted to occur.

19. A user characterization system comprising an electronic aerosol provision system configured to generate aerosol from an aerosol generating material for a user inhalation and in turn comprising an airflow detector, the user characterization system comprising:

a processor operable to detect an airflow associated with a start of the user inhalation upon the aerosol provision system;

a gradient captivating processor operable to calculate a gradient for the airflow during a first period following the start of inhalation;

a prediction processor operable to predict at least one of an inhalation intensity and an inhalation duration, based upon the calculated gradient; and a control unit operable to cause an adjustment of one or more operational parameters of the aerosol provision system in response to the at least one predicted inhalation intensity and predicted inhalation duration;

wherein one or more operational parameters of the aerosol provision system are adjusted to modify the composition of the generated aerosol at a predetermined point in the predicted inhalation duration.

20. A user characterization system comprising an electronic aerosol provision system configured to generate aerosol from an aerosol generating material for a user inhalation and in turn comprising an airflow detector, the user characterization system comprising:

a processor operable to detect an airflow associated with a start of the user inhalation upon the aerosol provision system;

a gradient captivating processor operable to calculate a gradient for the airflow during a first period following the start of inhalation;

a prediction processor operable to predict at least one of an inhalation intensity and an inhalation duration, based upon the calculated gradient; and a control unit operable to cause an adjustment of one or more operational parameters of the aerosol provision system in response to the at least one predicted inhalation intensity and predicted inhalation duration;

wherein the adjustment by the control unit of the one or more operational parameters comprises adjusting a rate of generation of aerosol responsive to the predicted inhalation intensity;

wherein the prediction by the prediction processor of the inhalation intensity further comprises predicting when a peak airflow will occur; and wherein the control unit is configured to increase the rate of generation of aerosol for a period responsive to when the peak airflow is predicted to occur.

* * * * *